United States Patent [19]

van Esdonk et al.

[11] 4,207,656

[45] Jun. 17, 1980

[54] COLOR TELEVISION DISPLAY TUBE AND METHOD OF MANUFACTURING SAME

[75] Inventors: Johannes van Esdonk; Petrus F. A. Haans, both of Eindhoven, Netherlands

[73] Assignee: U.S. Philips Corporation, New York, N.Y.

[21] Appl. No.: 928,171

[22] Filed: Jul. 26, 1978

Related U.S. Application Data

[62] Division of Ser. No. 757,347, Jan. 6, 1977, Pat. No. 4,121,131.

[30] Foreign Application Priority Data

Jan. 16, 1976 [NL] Netherlands ..... 7600422

[51] Int. Cl.[2] ..... H01J 9/14; H01J 9/18

[52] U.S. Cl. ..... 29/25.14

[58] Field of Search ..... 29/25.13, 25.14

[56] References Cited

U.S. PATENT DOCUMENTS 3,704,511 12/1972 Hooker ..... 29/592

OTHER PUBLICATIONS

IBM Technical Disclosure Bulletin, vol. 15, No. 8, Jan. 1973, pp. 2518–2519, "Gas Panel Sealant" by M. Beckerman et al.

IBM Technical Disclosure Bulletin, vol. 19, No. 10, Mar. 1977, pp. 3951–3952, "Spacing Technique . . ." by I. F. Chang et al.

IBM Technical Disclosure Bulletin, vol. 19, No. 4, Sep. 1976, pp. 1237–1238, "Spacer Rods . . ." by H. S. Klein.

*Primary Examiner*—Richard B. Lazarus

*Attorney, Agent, or Firm*—Algy Tamoshunas

[57] ABSTRACT

In an assembly of at least two electrodes which are connected together in an insulating manner, said electrodes are kept at a given distance from each other by at least one member of an electrically insulating material situated between the electrodes which comprises a core which determines the distance between the electrodes and a jacket which directly adheres to the electrode material by heating. The material of the core has a higher melting point than the material of the jacket so that the core during effecting a connection between the jacket and the electrode material maintains its shape.

4 Claims, 7 Drawing Figures

COLOR TELEVISION DISPLAY TUBE AND METHOD OF MANUFACTURING SAME

Figure 1A:
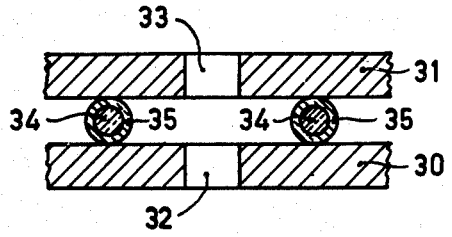

This is a, division, of application Ser. No. 757,347, filed Jan. 6, 1977.

The invention relates to a colour display tube provided with colour selection means comprising two lens electrode systems which are secured to each other by insulation material for postfocusing the electron beam generated in the tube.

The invention, furthermore, relates to a method of manufacturing such a colour display tube.

In the manufacture of electric discharge devices it is frequently necessary to assemble certain electrodes so that they are insulated from each other and are spaced apart at a defined distance, which often is very small. U.S. Pat. No. 2,916,649 discloses an electrode assembly of which adjacent electrodes are spaced apart by means of ceramic spacing members. The spacing members are maintained in their positions by cavities or holes in the electrodes, while the assembly is kept together by a compression spring. The accuracy in the distance between the electrodes depends not only on the tolerances in the dimensions of the spacing members but also on the tolerances in the dimensions of the cavities or holes in the electrodes. The use of pressure members to keep the electrode assembly together is, furthermore not always, possible.

U.S. Pat. No. 3,398,309 discloses a colour display tube of the post-focusing type in which a lens of the unipotential type is formed in each of the apertures of the colour selection means. The colour selection means consist of electrodes which are separated by two insulating layers and to which suitable potentials are applied so as to exert a focussing action on the electron beams passing through the apertures.

It is the object of the invention to provide a colour display tube of the post focusing type in which the colour selection means or electrode comprises a first and second system of lens electrodes which, on the one hand, are spaced apart at a defined distance from each other and, on the other hand, are mechanically secured together in an electrically insulating manner by a simple construction.

According to the present invention, the lens electrode of the first system is secured in an insulating manner, to the lens electrode of the second system by means of an insulating member disposed between the facing surfaces of the electrodes. The insulating member includes a core which determines the distance between the electrodes and a jacket which is adhered directly to the electrodes. The care is made from a material having a higher melting-point than the material of the jacket.

The advantage of the invention is that the spacing member between the electrodes forms one assembly with the material with which the electrodes are secured together. This considerably simplifies the assembly of the electrodes in comparison with a construction in which; the spacing member and the adhesive material are provided separately.

The insulating member preferably has a glass core and a glass jacket, the glass of the core having a higher softening temperature than the glass of the jacket. Alternatively, the insulating member may have a ceramic core and a glass jacket. The insulating member may have any desired geometrical shape, for example, a sphere or a cylinder. However, a cylindrical shape can be more readily realized than, for example, a spherical shape.

The colour selection means preferably only two systems of lens electrodes arranged so that upon application of a voltage difference between them, a quadrupole lens is formed in each of the apertures of the colour selection means. The electric field of the lens is at right angles to or substantially at right angles to the electron beams passing through the aperture. As compared with the colour selection means disclosed in U.S. Pat. No. 3,398,309, one advantage of the present colour selection means is that only two instead of three electrode systems need be connected together. In addition, a quadrupole lens is comparatively stronger than a unipotential lens so that a lower potential difference is required for the former.

In one embodiment of the colour selection means, a first system of lens electrodes is formed by a metal plate which is provided with apertures arranged in rows and the second system of lens electrodes is formed by a grid of conductive strips which are electrically connected together. The strips are positioned between the rows of apertures in the plate and are each kept at a predetermined distance from the plate by at least one insulating member having a core which determines the distance between the associated strip and the plate and a jacket which is secured directly to the strip and the plate. The core of the member is made of a material having a higher melting-point than the material of the jacket.

In another embodiment of the colour selection means, each of the two systems of lens electrodes is formed by a grid of conductive strips electrically connected together. The grids cross each other and are kept at a predetermined distance from each other by means of insulating members disposed between the grids. The insulating members each have a; core which determines the distance between the grids and a jacket which directly adheres to the material of the grids. The core of the insulating members is made of a material having a higher melting-point than the material of the jacket.

Figure 1B:
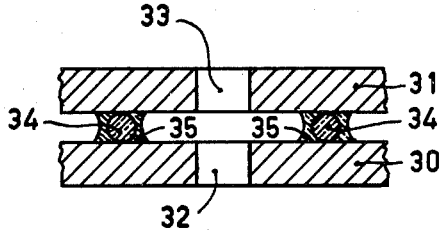
Figure 4:
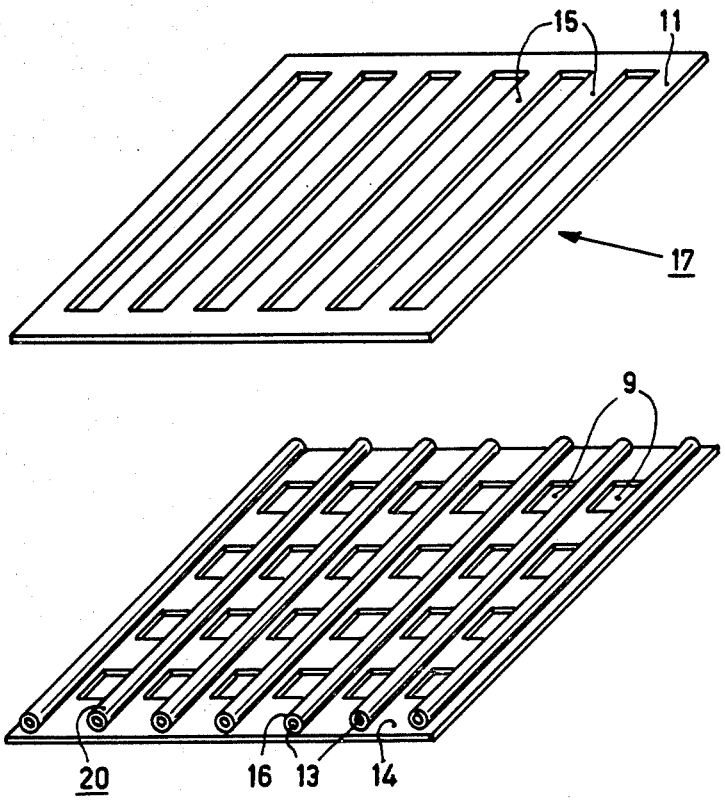
Figure 2:
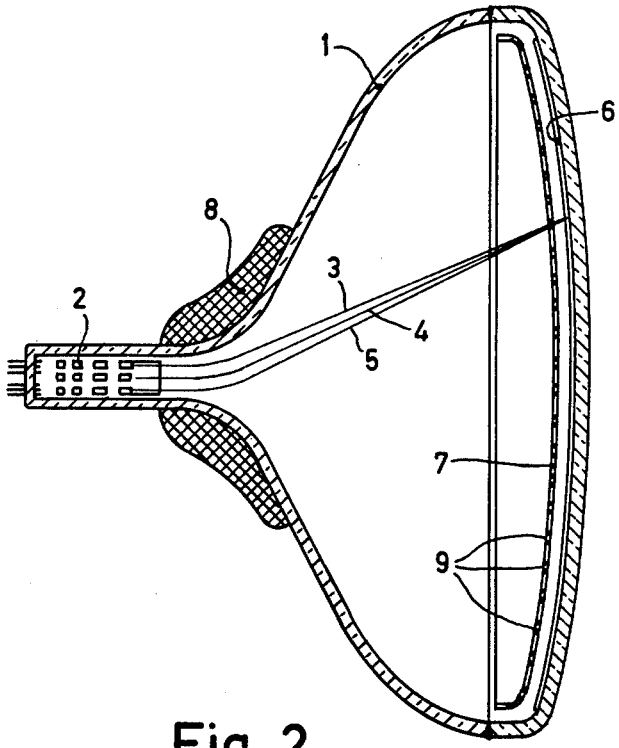
Figure 3:
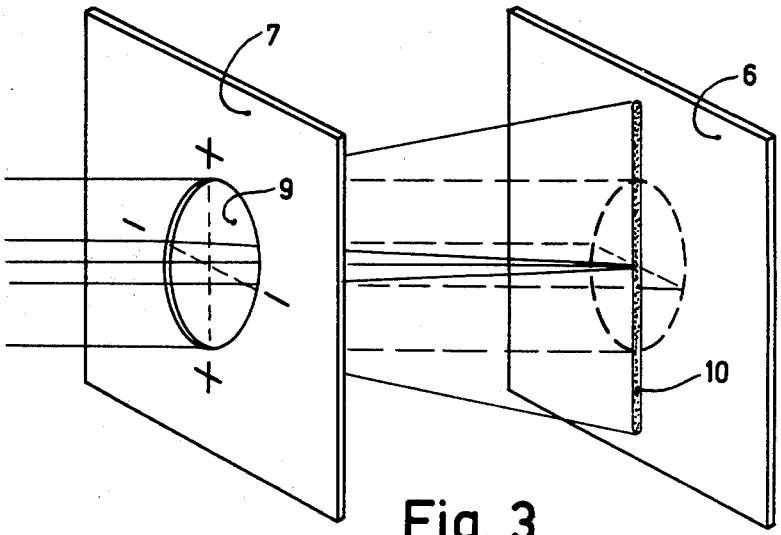
Figure 5:
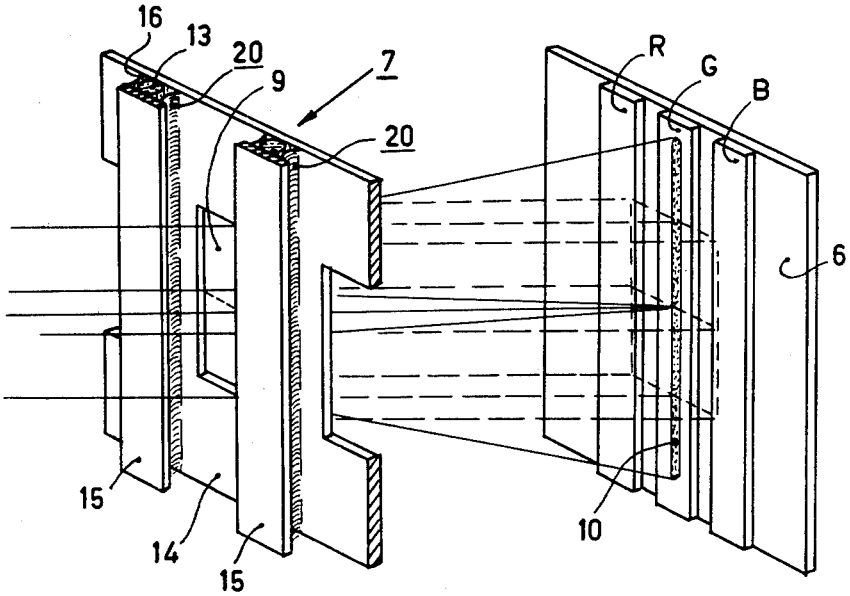
Figure 6:
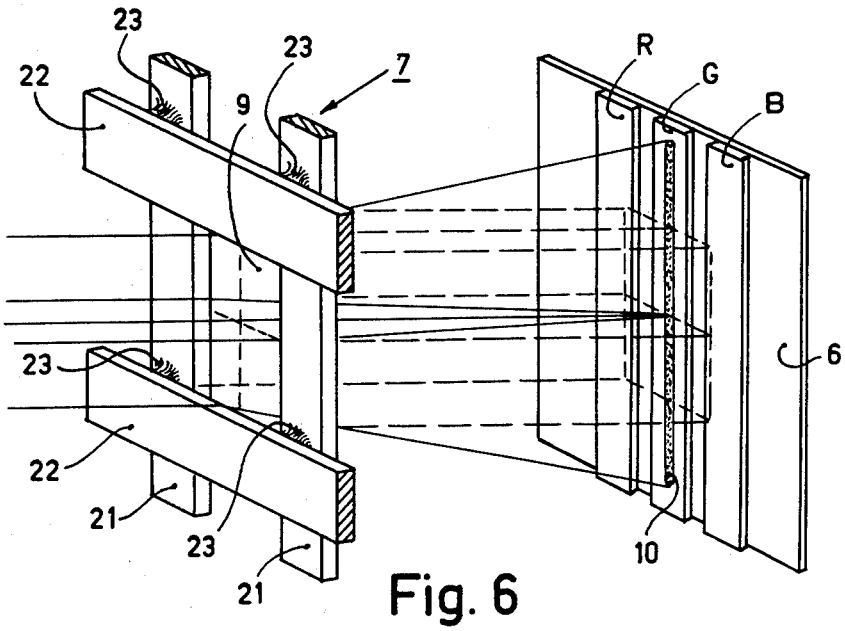

Embodiments of the invention will be described by way of example in greater detail with reference to the diagrammatic drawings, in which:

FIGS. 1*a* and 1*b* show two phases in the manufacture comprising an assembly of two electrodes secured together in an insulating manner and embodying the invention, FIG. 2 is a sectional view of a colour display tube provided with colour selection means comprising two systems of lens electrodes secured together and embodying the invention, FIG. 3 illustrates the postfocusing principle of a quadrupole lens, FIG. 4 shows an intermediate phase in the manufacture of an embodiment of colour selection means built up from two lens electrode systems, FIG. 5 shows a detail of the colour selection means shown in FIG. 4, and FIG. 6 shows a detail of another embodiment of the colour selection means.

The electrode assembly shown in FIGS. 1*a* and 1*b* includes a first electrode 30 and a second electrode 31 which form part of a first and a second system of lens electrodes. The two electrodes have apertures 32 and 33, respectively, for passing an electron beam. The electrode 30 is kept at a predetermined distance from the electrode 31 by two cylindrical members each comprising a fibre having a hard glass core 34 and a soft glass jacket 35. The core 34 has a diameter of 125 microns and is made of glass of the following composition: 69.7% by weight $SiO_2$, 17.4% by weight $Na_2O$, 0.2% by weight $K_2O$, 8.9% by weight CaO, 0.5% by weight ZnO, 0.6% by weight MnO, 2.6% by weight $Al_2O_3$ and 0.1% by weight MgO. The jacket 35 is made of a glass composition having 56% by weight $SiO_2$, 7.7% by weight $Na_2O$, 4.5% by weight $K_2O$, 29.8% by weight PbO, 1.4% by weight $Al_2O_3$, 0.4% by weight $Sb_2O_3$ and 0.2% by weight MnO. FIG. 1*a* shows the assembly before the electrodes are secured to each other. The assembly shown in FIG. 1*a* is heated in a furnace to a temperature at which the glass of the jacket softens but the core still maintains its shape. By means of, for example, a weight, the electrode 31 is pressed towards the elctrode 30 so that the jacket 35 is deformed and the glass thereof adheres to the elctrodes 30 and 31. Due to the higher softening temperature of the glass of the core, the latter maintains its shape and the distance between the electrodes is thus determined by the diameter of the core 34. After cooling, the assembly shown in FIG. 1*b* is obtained. The thickness of the jacket 35 is not critical and, for reasons of clarity, is shown to be much thicker in the drawing than is necessary for sufficient adhesion to the electrode surfaces. A jacket thickness of, for example, 25 microns is sufficient. For the manufacture of such fibers known methods may be used in which the starting material is, for example, a cylindrical member having a hard glass core and a soft glass jacket of a given diameter. This member is then heated and drawn in the longitudinal direction to form a fiber having the desired diameter. The composition of the glass of the core and the glass of the jacket is chosen in accordance with the requirements which are to be imposed thereon as regards, for example, the electrical insulation. A suitable glass composition for the core, for example, comprises: 52.8% by weight $SiO_2$, 28.8% by weight BaO, 9.6% by weight $K_2O$, 2.1% by weight $Na_2O$, 2% by weight CaO, 3% by weight $Al_2O_3$, 1% by weight $CeO_2$ and 0.7% by weight $LiO_2$, while the jacket is made of a potassiumzinc-phosphate glass or a barium aluminum borate glass. An embodiment of the invention will now be further explained in connection with a colour display tube provided with colour selection means which exert a postfocusing effect on the electron beams generated therein.

FIG. 2 shows a colour display tube having colour selection means comprising two electrode systems, which are secured to each other in the manner described with reference to FIG. 1. The tube has a glass envelope 1, means 2 for generating three electron beams 3, 4 and 5, a display screen 6, colour selection means 7 and deflection coils 8. The electron beams 3, 4 and 5 are generated in one plane, the plane of the drawing of FIG. 2, and are deflected over the display screen 6 by the deflection coils 8. The display screen 6 has a large number of phosphor strips luminescing in red, green and blue whose longitudinal direction is at right angles to the plane of the drawing of FIG. 2. During normal operation of the tube, the phosphor strips are vertical and FIG. 2 hence is a horizontal sectional view of the tube. The colour selection means 7 has a large number of apertures 9 in which a quadrupole lens is formed during operation of the tube. The three electron beams 3, 4 and 5 pass through the apertures 9 at a small angle with each other and hence each impinges only upon phosphor strips of one colour. The apertures 9 in the colour selection means 7 are, hence, very accurately positioned relative to the phosphor strips of the display screen 6.

FIG. 3 illustrates the principle of the postfocusing effect of a quadrupole lens and shows, a part of the colour selection means 7 and one of the apertures 9. The potential variation along the edge of the aperture 9, denoted by +, −, +, −, is such that a quadrupole lens is formed in the aperture. The electron beam which passes through the aperture 9 is focused in the horizontal plane and is defocused in the vertical plane so that, when the display screen is exactly at the horizontal focus, the electron spot 10 is formed. As will be described hereinafter, it is preferable not to focus exactly on the display screen 6 so that a slightly wider electron spot is obtained. There is only a minor influence on the focusing when the electron beam passes through the aperture 9 at a small angle. The colour selection of the three electron beams 3, 4 and 5, hence, takes place in a manner analogous to that of known shadow mask tubes. As a result of the strong postfocusing of the electron beams, however, the aperture 9 may be much larger than in known shadow mask tubes as a result of which, a much larger number of electrons impinge upon the display screen 6 and a brighter picture is obtained. The defocusing in a vertical direction need not be a drawback when phosphor strips are used which are parallel to the longitudinal direction of the spot 10.

A first embodiment of the colour selection means 7 will be described with reference to FIG. 4. The starting materials for making the colour selection means are a first iron plate 11 and a second iron plate 14. The two plates 11 and 14 have a thickness of 100 microns. By means of a known photoetching method, slots are etched in the plate 11 in a manner such that a grid 17 of parallel strips 15 is obtained. The strips have a width of 0.26 mm and the slots have a width of 0.54 mm. Square holes 9 of 0.54×0.54 mm are etched in the second iron plate 14 with a pitch of 0.8 mm so that an apertured plate is obtained. Fibers 20, having a hard glass core 13 with a diameter of 100 microns and a soft glass jacket 16, are positioned on the plate 14 between the rows of apertures 9. The grid 17, with the strips 15 positioned opposite the fibers 20, is pressed against the apertured plate. Thereafter, the assembly is heated in a furnace to the softening temperature of the glass of the jacket 16 but well below the softening temperature of the glass of the core. In a manner analogous to that described with reference to FIGS. 1*a* and 1*b*, the grid 17 is adhered to the apertured plate. The distance between the grid and the apertured plate is determined by the hard material of the core of the fibers and, hence, in this case, is 100 microns. The fibers 20 can be positioned on the apertured plate in several ways. Simultaneously with the etching of the apertures 9 in the plate 14, recesses can be etched on two opposite edges of the plate at a distance of 0.8 mm from each other. The position of the recesses is such that the line joining two opposite recesses lies centrally between two successive rows of apertures. The above-mentioned fibers are then wound as a continuous wire around the apertured plate and positioned in the recesses of the two oppositely located edges. In order to prevent the fiber from breaking at the edges of the apertured plate, it is advisable to lay the apertured plate on a thick base plate and to wind the fiber around the assembly formed by the base plate and apertured plate. The grid 17 is then pressed against the fibers by means of a pressure mould and the fibers are cut at the edge of the apertured plate. A second way of positioning the fibers is to use a template in the form of a grid having slots whose width is the same as the diameter of the fibers. Such a template is laid on the apertured plate with the slots positioned between the rows of apertures. The fibers are then positioned in the slots, after which the template may be removed. In this case it is necessary for the fibres to adhere to the plate so that they remain in position when the template is removed. For that purpose, a layer of adhesive may be provided on the plate which disappears, for example, at the temperatures at which final adhesion between the jacket of the fibres and the electrode material is realized. According to this method, spherical insulating members may be used instead of fibres. In that case, the template is a plate provided with apertures of the same size as the diameter of the spherical members.

After the electrode systems are assembled, the colour selection means can be given a shape corresponding to that of the display screen, for example a cylindrical shape, by welding it on a supporting frame with a cylindrically extending edge.

FIG. 5 shows a detail of a colour selection means obtained by the method described with reference to FIG. 4. For postfocusing the electron beams of which FIG. 5 shows only the beam directed on the green luminescing phosphor line G, the colour selection means may be operated at the following voltages. At a potential of the display screen 6 of 25 kV, a potential of the plate 14 of likewise 25 kV, and a potential of the conductive strips 15 of 23.4 kV, the focal distance of the quadrupole lenses is 18 mm with perpendicular incidence in the center of the display screen and 12.7 mm at the edge where the electron beams are incident at an angle of 37° to the normal of the display screen. The distance between display screen 6 and the colour selection means 7 is 15 mm in the center of the display screen and is 10 mm at the edge. The electron spots in the center of the display screen are then O, 10 mm wide and 0.09 mm wide in the corners. The width of the phosphor strips R, G and B is 0.13 mm. The remainder of the display screen may eventually be provided with a light-absorbing material.

Another embodiment of the colour selection means 7 is shown in FIG. 6. The two systems of lens electrodes are formed by grids of parallel metal strips having a thickness of 100 microns. Two strips 21 of the grid forming the first system and two strips 22 of the grid forming the second system are shown in FIG. 6. The strips 21 and 22 cross each other at right angles and are secured to each other only at the crossings by means of spherical insulating members. In this case, a template is used consisting of a plate having apertures of the same size as the diameter of the spherical members, as is indicated with reference to FIG. 4. It is also possible to use fibers for the insulating members and to use a slotted template for the positioning thereof. The longitudinal direction of the fibers then is parallel to that of the strips 22, so that the fibers are in the "shadow" of the strips 22 and the electron beams do not impinge on them. The strips have a width of 0.24 mm and a mutual pitch of 0.80 mm so that the transmission of the colour selection means is approximately 50% and each of the apertures 9 forms a square of 0.56×0.56 mm. At a potential of the display screen 6 of 25 kV and a potential of the horizontal conductors 22 of 25.45 kV and of the vertical conductors 21 of 24.55 kV, the focal distance of the quadrupole lenses is 18.0 mm in the center of the display screen with perpendicular incidence and is 12.7 mm at the edge where the electron beams are incident at an angle of approximately 37° to the normal of the display screen. The distance between the colour selection means 7 and the display screen 6 is 15 mm in the center and 10 mm at the edge, so that the focus of the quadrupole lenses is everywhere just slightly beyond the display screen so as to prevent a so-called focus ring from becoming visible on the display screen. The electron spots are then again approximately 0.10 mm wide so that a suitable width of the phosphor strips R, G and B is again 0.13 mm.

What is claimed is:

1. A method of making a colour display tube including an envelope having a display screen provided with a plurality of regions luminescing in different colours when struck by electrons and means for generating a plurality of electron beams directed towards said screen, said method comprising the steps of: positioning an insulating member on a metal sheet having a plurality of apertures arranged in spaced apart rows so that said insulating member extends between said rows and across said sheet, said insulating member having a solid core comprised entirely of an electrically insulating material and an outer jacket of an electrically insulating material, said jacket surrounding said core and having a softening temperature lower than the softening temperature of said core; bringing into contact with said insulating member a second apertured metal sheet oriented so that the apertures in said second sheet are aligned in a predetermined relationship with the apertures in the first-named sheet to form an assembly comprising said sheets with said insulating member therebetween; heating said assembly to a temperature at which said jacket is softened sufficiently to flow into contact with and adherently join said sheets to said core, said temperature being lower than said softening temperature of said core so that said core remains solid and forms an insulating spacer which maintains said sheets spaced a predetermined distance from each other to thereby form a colour selection electrode such that upon application of a potential difference between said sheets electron focusing fields are produced in said apertures; and mounting said electrode in said envelope between said screen and said beam generating means at a position relative to said screen such that said beams pass through said apertures and impinge on regions luminescing in different colours each associated with one of said beams.

2. The method according to claim 1 wherein said insulating member is a fiber and said step of positioning includes the step of winding said fiber around said first-named sheet.

3. The method according to claim 2 wherein said fiber has a core of glass having a relatively high softening temperature forming said core and a sheath of glass having a relatively low softening temperature forming said jacket.

4. The method according to claim 2 including the step of forming a plurality of spaced incisions in each of two opposite side-walls of said first-named sheet and positioning said fibers in said incisions during said winding.

* * * * *